United States Patent [19]

Marks

[11] Patent Number: 4,805,647

[45] Date of Patent: Feb. 21, 1989

[54] TIMER TO DISPENSER TOLERANCE TAKE-UP FOR DISHWASHER

[75] Inventor: Larry D. Marks, St. Joseph Township, Berrien County, Mich.

[73] Assignee: Whirlpool Corporation, Benton Harbor, Mich.

[21] Appl. No.: 901,008

[22] Filed: Aug. 27, 1986

[51] Int. Cl.[4] ..... B08B 13/00; A47L 15/44

[52] U.S. Cl. ..... 134/57 D; 134/93; 134/95; 222/651

[58] Field of Search ..... 134/57 D, 93, 95, 29; 222/129, 135, 651, 652, 639, 92, 343–345, 644

[56] References Cited

U.S. PATENT DOCUMENTS

| | | | |
|---|---|---|---|
| 2,490,634 | 12/1949 | Keene | 134/93 |
| 2,872,076 | 2/1959 | Bloom . | |
| 3,012,565 | 12/1961 | Lines . | |
| 3,102,664 | 9/1963 | Lines . | |
| 3,199,733 | 8/1965 | Perl . | |
| 3,344,957 | 10/1967 | Duncan et al. | 134/93 |
| 3,419,190 | 12/1968 | Kauffman et al. | 134/93 |
| 3,426,944 | 2/1969 | French | 134/93 |
| 3,827,600 | 8/1974 | Jonke | 134/93 |
| 3,850,185 | 11/1974 | Guth | 134/58 DL |
| 4,149,654 | 4/1979 | Nelson et al. | 222/651 |
| 4,149,655 | 4/1979 | Nelson et al. | 222/651 |
| 4,149,656 | 4/1979 | Nelson | 222/652 |
| 4,149,657 | 4/1979 | Nelson et al. | 222/651 |
| 4,355,738 | 10/1982 | Herbst et al. | 222/129 |
| 4,488,666 | 12/1984 | Herbst et al. | 222/651 |

*Primary Examiner*—Harvey C. Hornsby
*Assistant Examiner*—Joseph S. Machuga
*Attorney, Agent, or Firm*—Wood, Dalton, Phillips, Mason & Rowe

[57] ABSTRACT

According to the invention, structure is provided for interconnecting a timer mechanism and dispensing structure associated with a dishwashing apparatus. The timer mechanism has a cam with an associated follower with a free end that is engageable with a portion of an actuating member. In the operating cycle, motion is transmitted from the follower through the actuating member. In a given cycle, the actuating member and follower move in a prescribed path in one direction and retrace the path in a direction opposite to the one direction. Structure is provided to block the actuating member at its extreme position of travel in the one direction and to progressively adjustably interconnect the follower and actuating member as they are moved relative to each other. By so doing, the cam follower can be moved through its path by a manual control knob and engaged with the actuating member, that is blocked at its extreme position of travel in the one direction.

13 Claims, 4 Drawing Sheets

FIG. 1
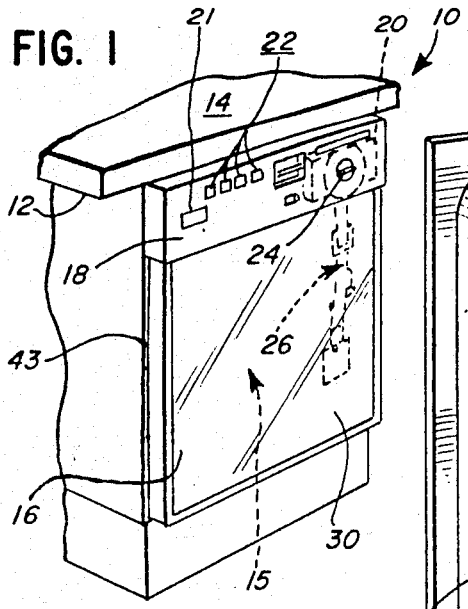
FIG. 2
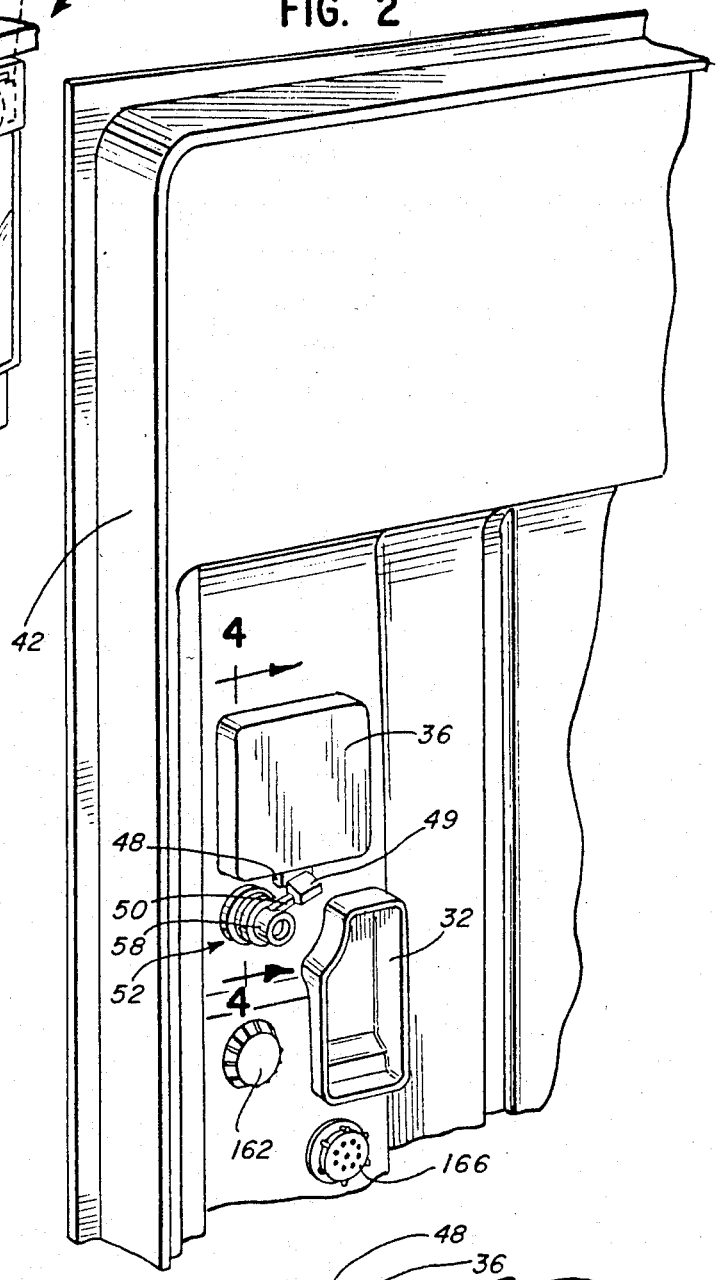
FIG. 4
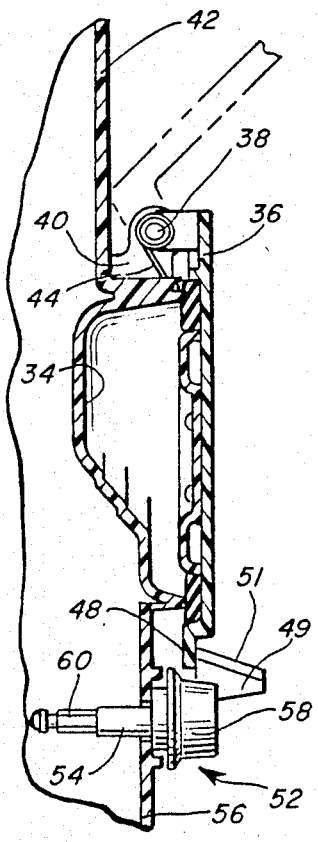
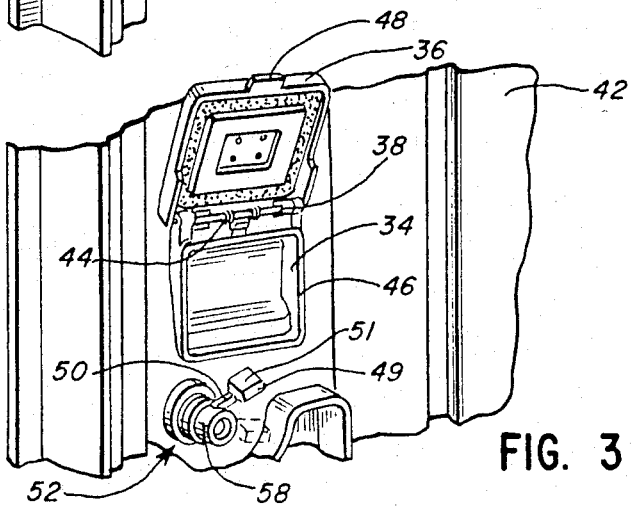
FIG. 3

FIG. 8
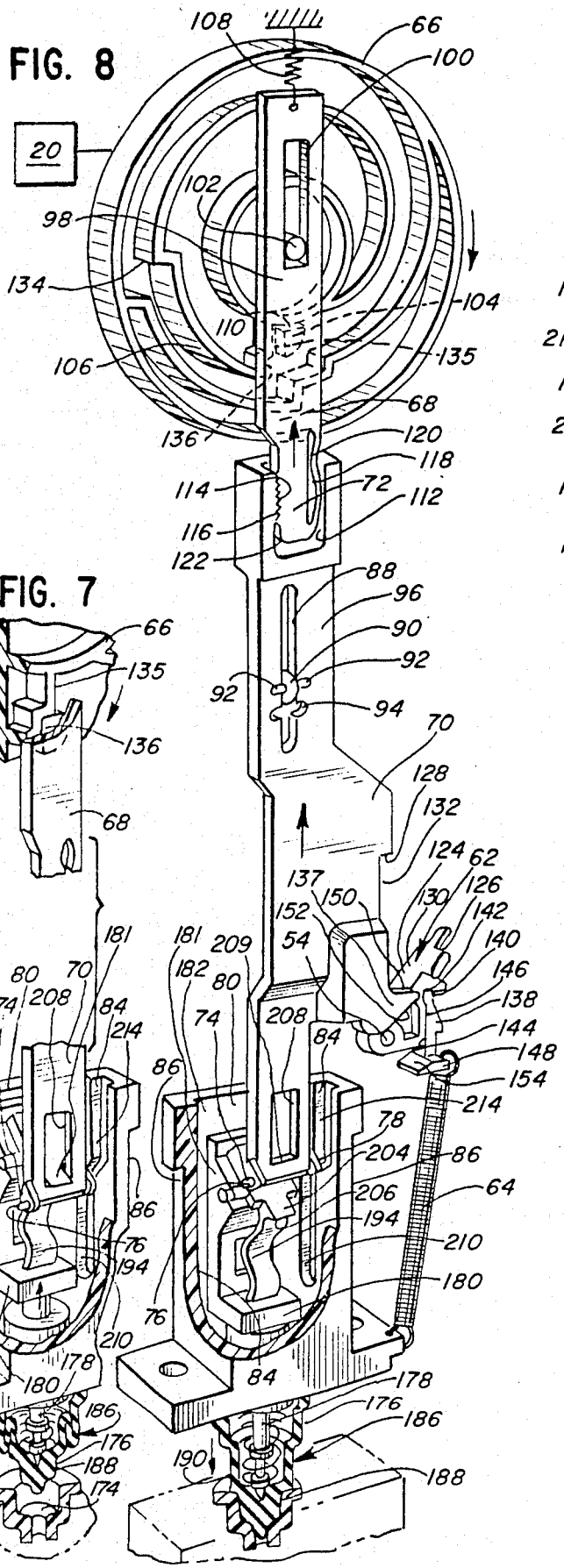
FIG. 7
FIG. 9
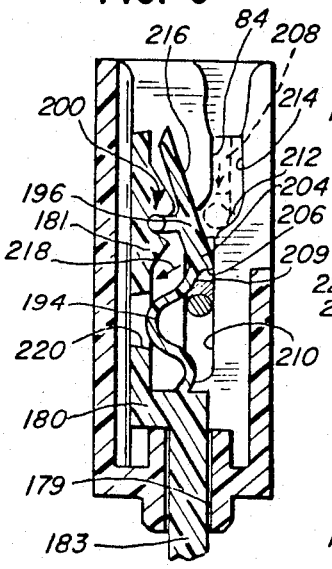
FIG. 10
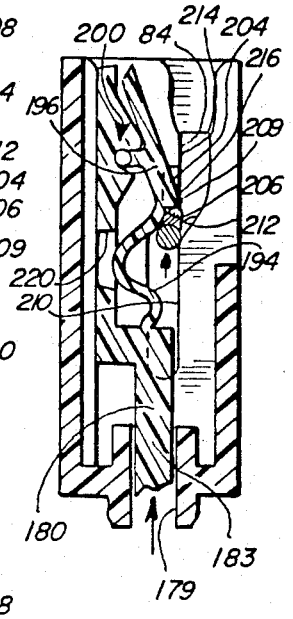
FIG. 11
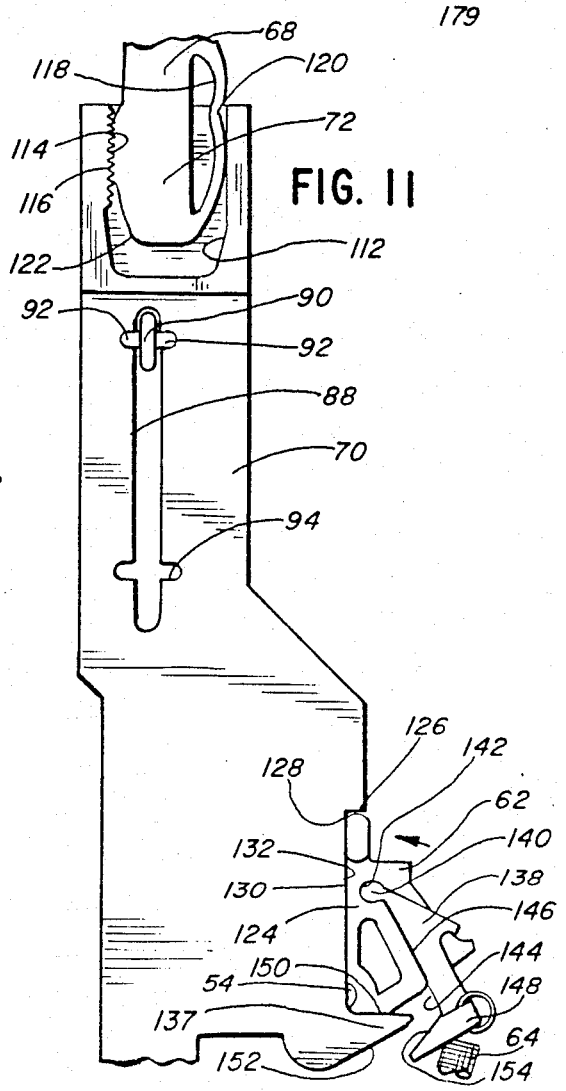

TIMER TO DISPENSER TOLERANCE TAKE-UP FOR DISHWASHER

BACKGROUND OF THE INVENTION

1. Field of the Invention

This invention relates to dishwashing apparatus and more particularly, to structure for interconnecting members on a linkage which operates between a timer mechanism and dispensing structure for an additive that is released into a wash chamber at a predetermined stage in an operating cycle.

2. Description of the Prior Art

It is known to provide a timer mechanism and an associated cam to shift a linkage to control dispensing of an additive into a wash chamber of a dishwashing apparatus. One exemplary linkage reciprocates during an operating cycle. As the number of elements on the linkage increases, the tolerances compound so that a compensation feature is desirable, such as one which adjustably interconnects cooperating members on the linkage.

One known manner to adjustably interconnect two members is to provide cooperating rows of teeth on each that are slidable, one over the other, to lockingly engage the members in any of a number of relative positions.

Such a structure has inherent drawbacks, particularly where the joined members are made of plastic. Assembly of the elements by press fitting the same together first of all puts undue stress on the linkage. Also, when the assembly force is removed, the joined members might not be in the desired operative relationship. Further, there may also be redisual stresses in the linkage members which ultimately may precipitate their failure or impair the operation of the mechanism. Thus, the assembler, to assure proper assembly of the linkage, must individually cycle and test each unit.

SUMMARY OF THE INVENTION

The present invention is specifically directed to overcoming the deficiencies in the prior art structures in a novel and simple manner.

According to the invention, structure is provided for interconnecting a timer mechanism and dispensing structure associated with a dishwashing apparatus. The timer mechanism has a cam with an associated follower with a free end that is engageable with a portion of an actuating member. In the operating cycle, motion is transmitted from the follower through the actuating member. In a given cycle, the actuating member and follower move in a prescribed path in one direction and retrace the path in a direction opposite to the one direction.

Structure is provided to block the actuating member at its extreme position of travel in the one direction and to progressively adjustably interconnect the follower and actuating member as they are moved against each other. By so doing, the cam follower can be moved in its path by a manual control knob and engaged with the actuating member that is blocked at its extreme position of travel in the one direction. Accordingly, the follower and actuating member are consistently located relative to each other. Additionally, the force of the cam follower is borne by the structure blocking the actuating member.

To effect interconnection of the cam follower and actuating member, elongate rows of teeth are provided on each. The rows of teeth are biased towards each other and, as the cam follower is urged towards the blocked actuating member, the teeth thereon ride over the teeth on the actuating member and progressively engage. The cooperating teeth afford a wide range of adjustment.

The invention also comprehends the provision of structure for separating the teeth on the cam follower and actuating member without reversing the assembly process.

Accordingly, the cam follower and actuating member can be simply interconnected by blocking the actuating member, aligning the cam follower with the actuating member and manually cycling the dishwashing apparatus. The blocking structure for the actuating member is constructed so that it will automatically release upon the cam follower reversing directions in its path.

In a further refinement of the invention, a lever that is normally operated by the actuating member during a cycle to dispense additive, is manually repositioned to afford the abutting structure that blocks movement of the actuating member as the actuating member and follower are assembled.

BRIEF DESCRIPTION OF THE DRAWINGS

FIG. 1 is a perspective view of a dishwashing apparatus incorporating additive dispensing structure according to the present invention;

FIG. 2 is a perspective view of the additive dispensing structure on the inside of a door for the dishwashing apparatus and with a cover for a detergent reservoir in a closed position;

FIG. 3 is a perspective view of the detergent reservoir in FIG. 2 with the cover in an open position;

FIG. 4 is an enlarged sectional view of the detergent reservoir and associated cover generally along line 4—4 of FIG. 2;

FIG. 7 is a view similar to that in FIGS. 5 and 6 with the dispensing structure arranged to release a liquid additive;

FIG. 8 is a view similar to that in FIGS. 5–7 after the liquid additive has been released;

FIG. 9 is an enlarged, sectional view of actuating structure for release of the liquid additive in a position prior to release thereof;

FIG. 10 is a view similar to that in FIG. 9 at the point of release of the liquid additive;

FIG. 11 is an enlarged, fragmentary, front elevation view of structure for controlling the interconnection of two elements on the dispensing structure.

DETAILED DESCRIPTION OF THE DRAWINGS

Figure 5:
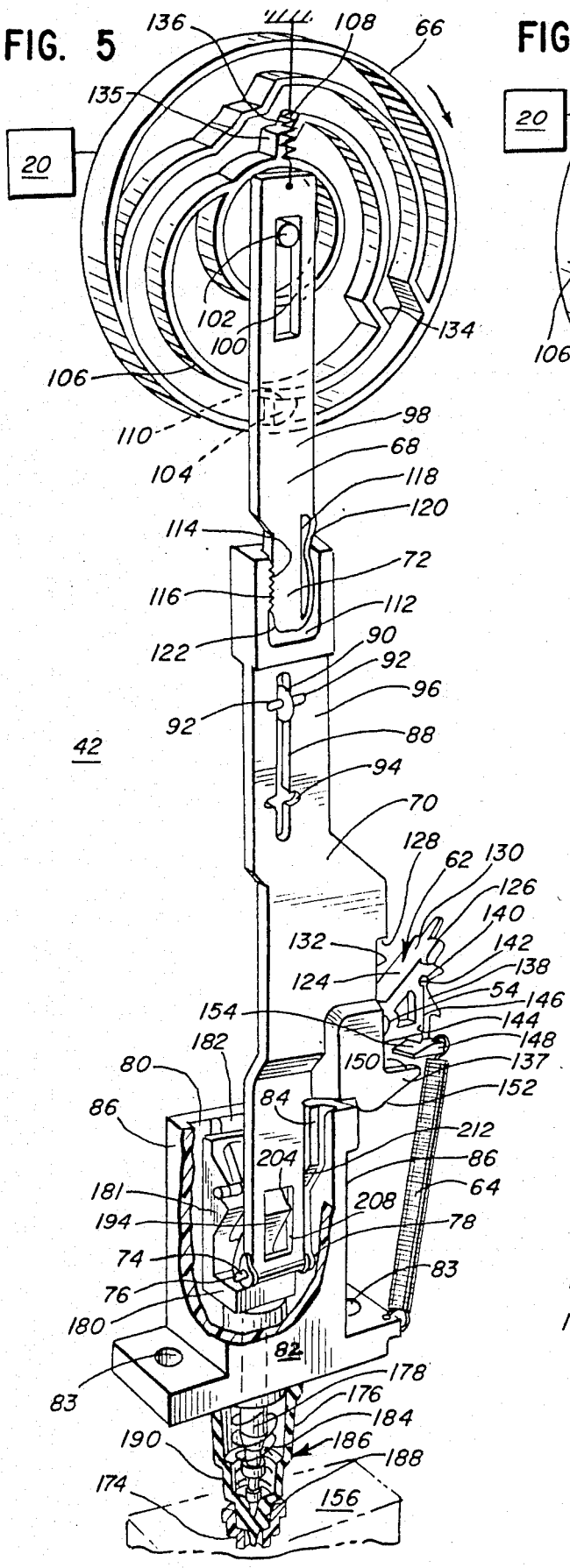
FIG. 5 is a front perspective view of the additive dispensing structure at a stage in the operating cycle prior to release of the cover for the detergent reservoir.
Figure 6:
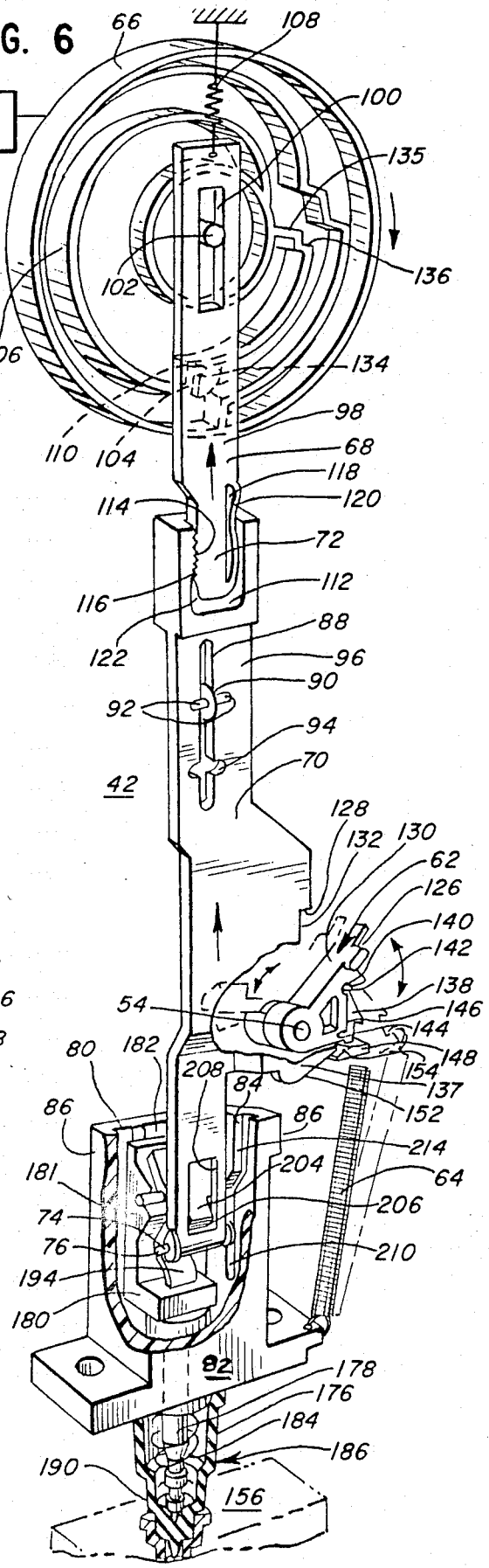
FIG. 6 is a view similar to that in FIG. 5 with the detergent cover released to an open position.

In FIG. 1 a dishwashing apparatus suitable for the incorporation of the present invention is shown at 10. The apparatus in FIG. 1 is an under-the-counter design and is floor mounted so that the top of the apparatus 10 resides closely beneath the underside 12 of a counter 14. A wash chamber at 15 accepts a plurality of racks for supporting dishes and utensils. The wash chamber 15 has an opening at its front which is accessed through a hinged door 16, shown in FIG. 1 in its closed position. The door 16 has an associated console 18 which houses the electrical controls for the dishwashing apparatus, including a conventional timer mechanism 20. The console 18 supports a vent 21, operator controls 22 and a knob 24 through which the user can manually cycle the timer mechanism 20.

The invention is embodied in the additive dispensing structure shown generally in phantom at 26 in FIG. 1, which structure is mounted on the door 16 behind the outside front door surface 30. The operation of a conventional dishwashing apparatus typically includes alternating wash and rinse cycles followed by a dry cycle. Typically two different additives are released into the wash chamber. A detergent is mixed in the chamber 14 during separate wash cycles and a rinse aid additive releases in a rinse cycle late in the operating cycle to prevent formation of water stains on the dishes and utensils as they dry.

As seen in FIGS. 2–4, the detergent is contained in two separate reservoirs 32, 34. The reservoirs 32, 34 and a mounting base 40 are integrally formed with a plastic liner 42 that is fit on the inside door surface 43 and faces inwardly toward the chamber 14. Reservoir 32 is always open to the wash chamber while reservoir 34 has an associated cover 36 that is hinged about a pin 38 mounted in base 40 for movement between a closed position shown in FIG. 2, wherein the cover 36 seals the reservoir 34, and an open position, shown in FIG. 3, wherein the door pivots so that the reservoir 34 is in open communication with the wash chamber 14. The cover position is automatically controlled by structure hereafter described.

Before the user starts the apparatus 10, both reservoirs 32, 34 are filled with a supply of detergent. The cover 36, which is normally biased to its open position by a coil spring 44, is moved manually against the spring bias to the closed position in FIG. 2, wherein it covers the reservoir 34 and bears on the peripheral edge 46 about the reservoir 34. The cover 36 has an associated offset tab 48, which can be engaged by an enlarged head 49 having an inclined surface 51 at the free end of a pivotable latch arm 50 so that the head 49 blocks the cover 36 in its closed position.

The latch arm 50 is part of a pivotable latch assembly 52. The latch assembly 52 has a shaft 54, which extends through the wall 56 of the liner. The shaft 54 makes keyed connection inside the door with a body 58, from which the latch arm 50 projects and has a splined portion 60 inside the door between the liner and front surface 30, which is splined to a lever 62 (FIGS. 5, 6, 8 and 11). As seen in FIGS. 5, 6, 8 and 11 and more fully described below, the lever 62 is biased by a coil spring 64 which urges the latch arm 50 in a counterclockwise direction in FIG. 2.

To lock the cover 36, the arm 50 is rotated clockwise in FIG. 2 by the action of tab 48 against inclined surface 51 as the cover 36 is rotated to its closed position sufficiently to allow clearance of the tab 48. With the cover 36 in its fully seated and closed position, the arm 50 passes tab 48 and is released so that the bias in spring 64 overtakes the arm and shifts it blockingly across the tab 48. To release the cover 36, the arm 50 must be pivoted against the bias of spring 64 downwardly to the position shown in phantom in FIG. 3 and, as this occurs, the cover will pivot open under the force of spring 44 to expose the inside of the reservoir 34 to the wash chamber 14. The first wash cycle uses the detergent in reservoir 32. A later wash cycle uses the detergent in reservoir 34 upon the cover 36 being released, which is accomplished automatically by the dispensing structure at 36, shown in detail in FIGS. 5–11, as dictated by the controlling timer mechanism 20.

Referring now to FIGS. 5–11, in which the inventive structure is detailed, it can be seen that the dispensing structure comprises generally a rotatable control cam 66, and associated cam follower 68 and an actuating member 70 which is joinable with the bottom free end 72 of the cam follower 68 as hereafter described. The cam follower 68 and actuating member 70 are preferably formed of plastic and cooperatively define an elongate link that is movable longitudinally thereof upon rotation of the control cam 66 which is driven by the timer through a drive pin 102 as the dishwashing apparatus is cycled by the timer mechanism 20, shown schematically in each of FIGS. 5, 6 and 8.

At its lower end, the actuating member 70 mounts a pin 74 having oppositely projecting free ends 76, 78, which are admitted through the open end 80 of a support block 82 mounted on the liner 42 by conventional means such as screws through openings 83. The ends 76, 78 fit into spaced guide slots 84, which are formed in lateral block walls 86 and open towards each other. At the upper region of the actuating member 70, a T-shape slot 88 having a cross bar 94 is defined. The liner 42 has an associated disk-shaped projection 90 with lugs 92 projecting in opposite directions from the faces thereof.

To assemble the actuating member 70, the pin ends 76, 78 are first introduced to the slots 84 and the member 70 is moved sufficiently downwardly to align the lugs 92 with the cross bar 94 of the T-shaped slot 88. With the lugs 92 directed entirely through the slot, the actuating member 70 can be shifted downwardly so that the lugs 92 overlie the forwardly facing surface 96 of the actuating member 70 and thereby confine forward tilting of the upper portion of the member 70 relative to the liner 42.

The cam follower 68 has an elongate body 98, defining a lengthwise rectangular slot 100, which accepts drive pin 102 projecting rearwardly of the door at the rotational axis of the cam 66. The pin guides vertical movement of the cam follower. The cam follower 68 has a forwardly projecting guide lug 104 which traverses the three step, cam surface 106 on the control cam 66. The cam follower 68 is biased upwardly by a coil spring 108 so that an upwardly facing guide surface 110 on the lug 104 maintains intimate contact with the cam surface 106 and the cam follower 68 responds positively and consistently to the movement of the control cam 66.

The upper region of the actuating member 70 defines an upwardly opening, rectangular recess 112 with an integrally formed row of teeth 114 extending lengthwise of the member 70 at one side of the recess 112. The cam follower 68 has at its lower free end a lengthwise row of teeth 116 for cooperation with the teeth 114 on the actuating member 70. The lower portion of the cam follower has a weakening cut-out 118 which defines a flexible side 120 that is collapsible into the cut-out 118 to effectively narrow the width of the cam follower 68 at its bottom portion. The bottom of the cam follower has a rounded leading edge 122 for guiding the cam follower into the recess 112 in the member 70.

By moving the cam follower 68 and member 70 towards each other in a longitudinal direction, with the lower portion of the cam follower introduced to the recess 112, the teeth progressively engage to prevent separation of the cam follower and member 70. Because the lower end of the cam follower 68 is slightly wider than the width of the recess 112, the side 120 will collapse into the cut-out 118 and thereby exert a bias on the row of teeth 116 on the cam follower toward the row of teeth 114 on the member 70. As the cam follower and member 70 are urged longitudinally towards each other, the teeth engage and ride over each other which is made possible by a slight lateral shifting of the cam follower against the bias established by the side 120. The cooperating rows of teeth 112, 114, make it possible for the cam follower 68 and member 70 to be locked relative to each other in a plurality of longitudinal positions as dictated by the number and spacing of teeth.

The lever 62 is used to establish a desired relationship between the cam follower and member 70. The lever 62 has an associated arm 124 with a surface 126 at its free end that can be disposed beneath a downwardly facing shoulder 128 on the member 70. The surface 126 is placed in the path of the shoulder by pivoting the lever 62 about the lever shaft 54 in a counterclockwise direction until, as shown in FIG. 11, a flat surface 130 on the arm 124 facially encounters a laterally facing surface 132 on the actuating member 70 and blocks downward movement thereof. The actuating member 70 can be shifted downwardly with the surfaces 130, 132 against each other until the surface 126 and shoulder 128 abut, at which point furthe downward shifting of the actuating member 70 is arrested.

With the cam follower 68 in operative relationship with the control cam 66 and the free end of the cam follower introduced at the top of the recess 112, the cam 66 can be manually rotated through the knob 24 through a complete operating cycle. The rows of teeth 114, 116 will progressively increase in overlap until the extreme downward travel position of the cam follower is realized. The combined length of the cam follower 68 and actuating member 70 can be precisely established by the assembler and connection involves only the simple steps of pivoting the lever 62 to abut the actuating member 70 and thereafter manually cycling the control cam 66. Not only does this assure consistent, predetermined relationship between the actuating member and cam follower, but it also assures that undue stress is not transmitted through the linkage between the timer mechanism 20 and lever 62 during assembly and operation. After the actuating member 70 reaches its downwardmost travel position, it will be drawn upwardly and, as this occurs, the bias of spring 64 will urge the lever 62 to its normal position in a clockwise direction from that shown in FIG. 11.

To facilitate separation of the cam follower 68 and actuating member 70, the front side of the recess 112 is open. This permits the cam follower to be drawn rearwardly of the door to separate the teeth on the cam follower and actuating member and obviates having to force the teeth on the cam follower over the teeth on the actuating member by moving the cam follower 68 and actuating member 70 longitudinally away from each other.

It can be seen that the contour of cam surface 106 causes joined cam follower 68 and actuating member 70 to follow a reciprocating path as the apparatus is cycled. The cam follower 68 is urged progressively downwardly from its FIG. 8 position as the cam rotates clockwise in FIG. 8. The extreme downward position of the cam follower is achieved with the lug at the position immediately adjacent the first cam step 134 (FIG. 5). A second cam step 136 moves the cam follower from an intermediate position to its FIG. 8 position upon continued rotation of the cam.

Operation of the detergent door latch in response to movement of the cam follower 68 and actuating member 70 is accomplished through the cooperation of a lateral projection 137 on the actuating member 70 with a trigger arm 138 associated with the lever 62. The trigger arm 138 has a cylindrical portion 140 which snaps into a cylindrical slot 142 on the lever so that the trigger arm 138 pivots about an axis substantially parallel to but spaced from the axis of pivoting of the shaft 54. The trigger arm 138 has a laterally projecting, flat surface 144 which is borne by the force of spring 64, connected between the trigger arm 138 and support block 82, facially against a laterally facing surface 146 on the lever 62. This imparts the aforementioned bias to the lever 62 in the clockwise direction in FIGS. 5, 6, 8 and 11.

The free end of the trigger arm 138 has an enlarged head 148 which projects rearwardly of the lever 62 and into the path of movement of the lateral projection 137 of the actuating member 70. Upon the actuating member 70 moving from its FIG. 5 position towards a later wash cycle, the member 70 moves upwardly at cam surface 134 and bears an upwardly directed edge 150 against the underside of the enlarged head 148 of the trigger arm, thereby causing a counterclockwise rotation to be imparted to the lever 62 and as an incident thereof the latch arm 50 pivots from its FIG. 3 position to the position shown in phantom in FIG. 3 so that the cover 36 is released and moves to an open position in preparation for the subsequent wash cycle. Continued operation of the timer mechanism causes the projection 137 to pass vertically beyond the enlarged head 148 of the trigger arm 138 at which point the spring 64 draws the trigger arm and lever 62 clockwise to its position in FIGS. 5, 6, 8 and 11.

Sometimes, a user may interrupt operation of the dishwashing apparatus in mid-cycle. For example, with the dispensing structure in the FIG. 8 position, a user may manually reset the timer mechanism 20. This involves moving the cam follower and associated actuating mechanism from the FIG. 8 position to the FIG. 5 position. This can be accomplished with the inventive structure without having to reset the cover 36 and is made possible by the connection of the trigger arm with the lever.

According to the invention, the trigger arm is rotatable counterclockwise in FIGS. 5, 6, 8 and 11 relative to the lever against only the resistance developed by spring 64. As the bottom edge 152 of the lateral projection 137 encounters the head 148 of the trigger arm, the trigger arm pivots sufficiently to allow the part 137 to go downwardly beyond the trigger arm without pivoting the lever 62. To facilitate deflection of the trigger arm, the bottom edge 152 is inclined in the same direction as an upwardly facing surface 154 at the free end of the trigger arm. The bottom edge 152 of the part 137 progressively deflects the trigger arm in a counterclockwise, rotative path until clearance is made. Accordingly, the user is given the freedom of manually moving the actuating member downwardly past the trigger arm without having to reset the cover 36 over the reservoir 34. This prevents inadvertent release of detergent in reservoir 34 into the wash chamber prior to a subsequent wash cycle.

Figure 12:
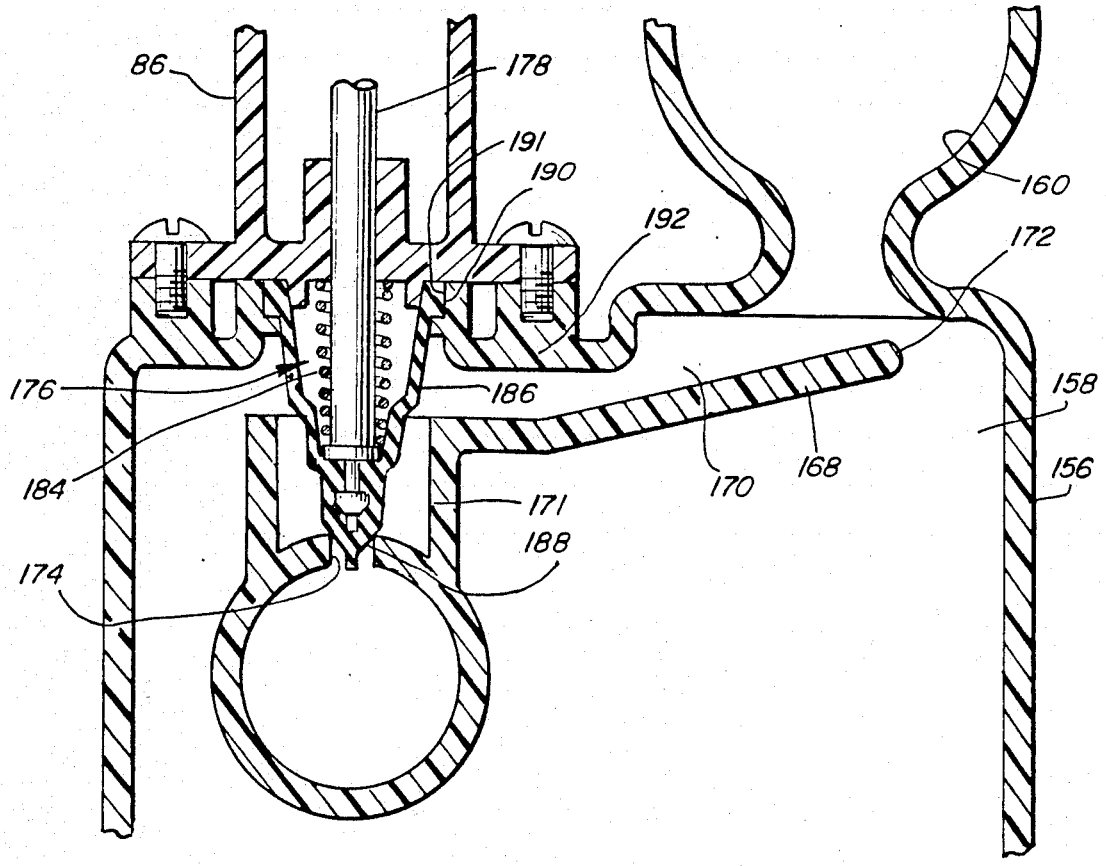
FIG. 12 is a rear elevation view of a reservoir for containing liquid additive.

The cam follower 68 and actuating member 70 are also responsible for releasing a rinse aid additive into the wash chamber at a prescribed stage in the operating cycle. The rinse additive is distributed in the wash chamber during a rinsing cycle and minimizes adherence of residue on the dishes as they dry after being rinsed. A container 156 (FIGS. 5, 6 and 12) has an internal chamber 158 for retaining a supply of the liquid rinse aid. The container 156 is mounted inside the door and has a conduit 160 directed rearwardly through the inside wall 56 of the liner. The conduit 160 communicates with the chamber 158 and is accessible through the rear side of the plastic liner with the door open. A cap 162 (FIG. 2) is screw threaded to and seals the conduit. Also projecting through the liner wall 56 is a discharge conduit 164 with an associated porous cap 166 (FIG. 2). At a predetermined stage in the operating cycle, a charge of rinse aid is delivered from the chamber 158 through the cap 166 into the wash chamber.

To control the size of the charge delivered to the wash chamber 15, the chamber 158 has a baffle 168 which partially encloses a flow directing baffle 168 defining a collecting area 170 and a metering cavity 171. With the door moved to its open horizontal position, liquid from chamber 158 finds its way around the free end 172 of the baffle 168 and into the area 170. The metering cavity is recharged each time the door is opened. Upon returning the door to its vertical position, the bulk of liquid flows gravitationally to the bottom of the container 156 while a charge is trapped by the baffle in the cavity 171. The metering cavity 171 communicates with the conduit 164 through a port 174. Discharge of the liquid from the metering cavity 171 through the port 174 and cap 166 is controlled by a plunger 176, which is moved upwardly to allow the rinse additive to discharge by gravity into the wash chamber 15.

The rinse aid dispensing mechanism is detailed in FIGS. 5–10 and 11. The plunger 176 has an internal control stem 178 which is part of a control element 180 which slides guidingly upwardly and downwardly in a recess 182 in the block 82. The element 180 is guided principally by an associated leg 183 connecting the stem 178 and body 181 of the element 180. The leg moves vertically in a channel 179 defined by the block 82 and closely matched to the cross-section of the leg 183. A coil spring 184 biases the plunger and associated control element 180 downwardly into sealing engagement with the port 174 as shown in FIGS. 5, 6, 8 and 12. The plunger has a stepped outer surface 186, with the port 174 sealed by a first diameter portion 188. A larger diameter portion 190 (FIG. 12) seals an opening 191 in the upper wall 192 of the container 156. With the plunger in its downwardmost position, the port 174 is sealed by the plunger. Upward movement of the plunger opens the port allowing vented circulation of the liquid from the metering cavity 171 into the wash chamber 15.

Referring to FIGS. 9 and 10, the control element 180 has a collapsible, serpentine, trigger section 194 extending between the leg 183 and body 181. The upper portion of section 194 is hingedly connected to the body at 200. The section 194 is enlarged at its upper region 196 and defines a rearward projection 204 having a downwardly facing shoulder 206. The projection 204 is received in a rectangular opening 208 (FIG. 7) having a lower surface 209 in the bottom portion of the actuating member 70. The opening allows a limited amount of relative vertical shifting between the projection 204 and actuating arm 70.

Before the actuating member 70 is assembled, the guide element 180 rests in the FIG. 9 position, being drawn downwardly by the coil spring 184. In the FIG. 9 position, the projection 204 and shoulder 206 reside in the path of the pin 74, which moves in the slots 84. The slots 84, as seen clearly in FIGS. 9 and 10, each comprise a lower vertically extending portion 210, an offset portion 212 slightly above the projection 204 in the FIG. 9 positior and a second vertically extending portion 214 above the offset portion 212.

With the pin free ends 76, 78 in the slots 84 and the actuating member moved downwardly during assembly (shown in phantom in FIG. 9), the pin 74 traversing the offset portion 212 of the slot encounters an angled surface 216 on the enlarged portion 196. Further downward movement of the actuating member 70 deflects a portion of the section 194 in the direction of arrow 218 in FIG. 9 forwardly into a recess 220 in the guide element 180. Upon continued downward movement of the actuating member, the lower surfacd 209 of opening 208 clears the projection 204 and allows the collapsible section 194 to reassume its FIG. 9 position. In the FIG. 9 position, the shoulder 206 blocks against surface 209 to prevent upward movement of pin 76 so that the pin 74 is effectively captured therein. With the actuating member 70 so positioned, the projection 204 extends through the opening 208 and thereby guides relative vertical movement of the guide element 180 and actuating member 70.

A charge of the rinse aid additive is released upon the actuating member moving upwardly and thereby drawing with it the guide element and plunger. As shown in FIG. 10, the surface 209 bears upwardly against the shoulder 206 as the actuating member rises and shifts the guide element 180 upwardly. This occurs as the guide lug 104 approaches the second step 136 on the cam 66. As the pin 74 reaches the offset portion 212 of the slot, drawing with it the guide element 80, the pin 74 will shift outwardly into the offset simultaneously as the lug 104 moves upwardly a third offset 135 to its FIG. 8 position. Movement of the guide element 180 upwardly to the point of separation draws the plunger upwardly sufficiently to release the rinse aid liquid into the wash chamber. Upon the pin and thus surface 209 clearing the projection 204 when lug 104 reches offset 135, the coil spring 184 draws the guide element downwardly so as to bring the plunger into sealing engagement with the container.

A short summary of the operation of the dispenser mechanism is as follows. At the beginning of the dishwasher cycle the cam 66 and follower 68 are in the positions shown in FIG. 5. As the cam rotates in the clockwise direction driven by the timer 20 the lug 104 of cam follower 68 travels against surface 106 of the cam 66. When the rotation of the cam brings the follower to the first step 106 the bias of spring 108 rapidly moves the cam follower upward forcing the projection 137 against the enlarged head 148 which rotates latch arm 50 so that head 49 unblocks the cover 36. The cover is rotated by the spring 38 to the open position such that the detergent contents of the cup 34 are free to be washed from the cup by water within the washing chamber. The cam 66 is now in the position shown in FIG. 6 and as it continues its rotation the lug 104 approaches the second step 136. When the lug 104 reaches the step 136 the cam follower and lever 70 are pulled upward with surface 209 pulling projection 204 upward. Movement upward of the projection 204 lifts the plunger 176 from its seat allowing rinse additive in the metering cavity 171 to flow into the dishwashing chamber. As the cam 66 continues further rotation, the lug 104 reaches the third step in the cam 135. At this point cam follower 68 and member 170 move upwardly again to their uppermost position moving surface 209 past projection 204 and allowing the force of spring 184 to return the plunger 176 to its seated position. Further rotation of cam 66 through the remainder of the cycle brings the lug 104 in cam follower 68 back to the position of FIG. 5. During this travel of cam 66 the follower 68 moves downward such that projection 137 is forced past enlarged head 148 and surface 209 is forced past projection 206. The dispenser actuating mechanism is now in position to repeat the actuation cycle. If for any reason, after the operation of the detergent dispenser cover to its open position, the operator should manually rotate the timer mechanism it will be noted that the steps 136 and 135 are closely adjacent each other such that during manual rotation the plunger 176 would be raised and lowered from its seat in rapid succession such that only a small amount of rinse aid would be allowed to exit the metering cavity 171. Thus, even though the timer would be manually rotated to its starting position, and the door not opened sufficiently to recharge the metering chamber, there would be sufficient rinse aid left in the chamber 171 to provide rinse aid at the proper point in the cycle to perform the rinse aid function.

It can be seen that the container is positively sealed by the plunger and that the snap-fit engagement of the collapsible section 194 and actuating member can be accomplished without releasing a charge of the liquid additive. Movement of the actuating member downwardly through the operating cycle will effect engagement of the actuating member 70 and guide element 180 without releasing rinse aid additive, while movement of the actuating member upwardly releases the plunger for a sufficient time to discharge the additive into the wash chamber.

The foregoing disclosure of specific embodiments is intended to be illustrative of the broad concepts comprehended by the invention.

I claim:

1. In a dishwashing apparatus having a tub defining a wash chamber and having a timer mechanism for controlling operation of the dishwashing apparatus through an operating cycle, a reservoir for containing a supply of washing additive, and dispensing means for selectively closing said reservoir as a result of the dispensing means being disposed in a first position and opening the reservoir to release additive therefrom into the wash chamber as a result of the dispensing means being disposed in a second position, improved structure for connecting between the timer mechanism and dispensing means comprising:

a cam follower associated with the timer mechanism and movable in a prescribed path in response to operation of the timer mechanism as the dishwashing apparatus is cycled and residing in a first position at a predetermined stage in an operating cycle;

an actuating member for connection with the cam follower and movable to change the dispensing means from the first position to the second position;

means for blocking movement of the actuating member with the actuating member in an intended position of the actuating member at said predetermined stage of an operating cycle; and cooperating means on the cam follower and actuating member for adjustably fixing the relative positions of the cam follower and actuating member as the actuating member and cam follower are moved relative to each other, whereby the actuating member can be blocked by the means for blocking movement in the intended position of the actuating member at the predetermined stage of an operating cycle and the timer mechanism can be cycled to move the cam follower to the first position thereof to establish consistent interconnection of the cam follower and actuating member in operative position.

2. A dishwashing apparatus according to claim 1 wherein means mount the cam follower and actuating member for substantially linear movement and said means for adjustably fixing is engaged by directing the cam follower linearly towards the actuating member.

3. A dishwashing apparatus according to claim 1 whwerein the timer mechanism has a cam structure which moves the cam follower to its first position as the dishwashing apparatus is cycled and means are provided to manually cycle the dishwasher so that the operative position of the cam follower and actuating member can be established by blocking the actuating member by the means for blocking movement and manually cycling the dishwashing apparatus through the means to manually cycle until the first position of the cam follower is realized.

4. A dishwashing apparatus according to claim 1 wherein the cooperating means comprises a row of cooperating teeth on each of the cam follower and actuating member and means for biasing the row of teeth on one of the cam follower and actuating member against the row of teeth on the other of the cam follower and actuating member whereby the row of teeth on the one of the cam follower and actuating member moves against the biasing means to allow the rows of teeth to shift relative to each other as the actuating member and cam follower are moved relative to each other.

5. A dishwashing apparatus according to claim 1 wherein said actuating member and cam follower each move in a first direction during a portion of an operating cycle to an extreme position and oppositely to the first direction in another portion of an operating cycle, said blocking means blocks the actuating member at its extreme position and the first position of the follower is the extreme position of the follower.

6. A dishwashing apparatus according to claim 1 wherein the cooperating means comprises a row of cooperating teeth on each of the cam follower and actuating member, one of said cam follower and actuating member has a flexible side and the other of the cam follower and actuating member has a recess formed therein and the one of the cam follower and actuating member is fit in the recess so that the flexible side biases the teeth on the one of the cam follower and actuating member toward the teeth on the other of the cam follower and actuating member, whereby the cam follower and actuating member can be moved relative to each other to progressively engage the rows of teeth and thereby adjustably fix the relative positions of the cam follower and actuating member.

7. A method for adjustably setting the relative positions of a cam follower and an actuating member on a dishwashing apparatus, said dishwashing apparatus having a dispensing means controlled by a timer mechanism through the cam follower and actuating member, said actuating member being associated with the dispensing means and movable in a prescribed path during an operating cycle for the dishwashing apparatus, said method comprising the steps of:

blocking said actuating member in a first position in which said actuating member is intended to be in at a predetermined stage in an operating cycle;

moving said timer mechanism to cause said cam follower to move relative to the actuating member to a second position that the cam follower is intended to be in with the dishwashing apparatus at the predetermined stage in an operating cycle; and fixing the cam follower and actuating member relative to each other in operative relationship with the actuating member in the first position and the cam follower in the second position.

8. The method according to claim 7 wherein the actuating member moves in a first direction to an extreme position during an operating cycle and the extreme position is the first position in which the actuating member is blocked.

9. The method according to claim 7 wherein the cam follower moves in a first direction to an extreme position during an operation cycle and the extreme position of the cam follower is the second position of the cam follower.

10. The method according to claim 7 wherein said cam follower is moved in a first direction relative to the actuating member to said operative relationship and after the operative relationship is established the timer mechanism is operated to move the cam follower opposite to said first direction.

11. The method according to claim 7 wherein a lever is pivotably mounted on the dishwashing apparatus and is biased in a first direction of rotation and the actuating member is blocked by the lever by manually rotating the lever in a direction opposite to the first direction of rotation of the lever against the actuating member.

12. The method according to claim 11 wherein said actuating member has a shoulder and the actuating member moves in a second direction as the timer mechanism is cycled and further comprising the step of urging the shoulder of the actuating member in said second direction against the lever to maintain the lever in a position wherein the lever blocks the actuating member in its first position as the relative positions of the actuating member and cam follower are being set.

13. The method according to claim 7 wherein means are provided to adjustably fix together the cam follower and actuating member as the cam follower and actuating member is moved relative to the the cam follower and actuating member are fixed in said operative relationship upon moving said cam follower relative to the actuating member which is blocked in the first position.

* * * * *